United States Patent [19]

Totsu

[11] 4,448,098

[45] May 15, 1984

[54] ELECTRICALLY DRIVEN SCREW-DRIVER

[76] Inventor: Katsuyuki Totsu, No. 1-17-8, Higashi-Mukojima, Sumida-ku, Tokyo, Japan

[21] Appl. No.: 356,895

[22] Filed: Mar. 10, 1982

[51] Int. Cl.[3] ..... B25B 23/14

[52] U.S. Cl. ..... 81/467; 81/57.11; 81/57.31

[58] Field of Search ..... 81/467, 473, 474, 478, 81/57.11, 57.14, 57.3, 57.31, 62

[56] References Cited

U.S. PATENT DOCUMENTS

| | | | |
|---|---|---|---|
| 2,031,133 | 2/1936 | Schumann | 81/57.31 |
| 2,715,955 | 8/1955 | Stone | 81/62 |
| 2,773,370 | 12/1956 | Intraub et al. | 81/474 |
| 2,979,089 | 4/1961 | Piesker | 81/57.31 |
| 4,086,831 | 5/1978 | Smith | 81/62 |

FOREIGN PATENT DOCUMENTS

| | | | |
|---|---|---|---|
| 2408431 | 7/1979 | France | 81/62 |

OTHER PUBLICATIONS 42,559/71, Jul. 25, 1968, Tonichi Seisakusho KK, Japan.

*Primary Examiner*—James L. Jones, Jr.

[57] ABSTRACT

An electrically driven screw-driver is disclosed in which a ratchet device is mounted to a portion of a chucking shaft to which a driver bit is detachably connected and the chucking shaft is connected to an output shaft of an electric motor through a planetary reduction system and in which a torque controlling mechanism having a clutch function is mounted to the planetary reduction system. In accordance with the electrically driven screw-driver, a combination of the ratchet device and the torque controlling mechanism permits the screw-driver to be operated in such a way that only the prefastening, or screwing step may be carried out mechanically and electrically while the finishing step of strong fastening may be performed manually, resulting in a very compact and light screw-driver which is very convenient in portability.

8 Claims, 6 Drawing Figures

ELECTRICALLY DRIVEN SCREW-DRIVER

FIELD OF THE INVENTION

This invention relates to an electrically driven screw-driver and more particularly to an electrically driven screw-driver which is very compact in size and convenient in portability and in which only a prefastening, or screwing step may be carried out by the mechanical force of an electric motor while a finishing step may be performed manually.

BACKGROUND OF THE INVENTION

Electrically driven screw-drivers (using an electric motor as a power source) may mostly be classified into two types, namely one which is directly connected to a commercial current source (100 V) and the other in which a current is supplied to a motor after reduction of its voltage with a transformer. In either case, a connection cord is indispensable for connecting the motor to the electric power source. These screw-drivers may utilize a higher electric output but may be operated portably in only the range of an extensible cord length. Thus, these types of electrically driven screw-drivers may be essentially used for an assembling process in a factory.

There is also known another type of electrically driven screw-driver which is of a charging type including a battery-replacement type. This type of screw-driver has a disadvantage of a lower output but has an advantage of portability due to the absence of a connecting cord. However, the conventional charging type of the screw-driver requires a possibly highest output of a motor and therefore a charging unit of a large capacity, resulting in a big and inconvenient appliance. Thus, it may well be stated that there has been no screw-driver of a charging type, which are small enough to be portable in a pocket, convenient in handling and resistant to a severe operational condition.

As mentioned hereinabove, a number of batteries are necessary as a power source for obtaining a higher and practical output for fastening, which prevents the screw-driver from being compact and light. Even a battery of a limited capacity may be used for obtaining a higher output if the large number of reduction steps are utilized in a reduction system connected to the motor. However, such higher reduction ratio brings about a decrease in rotation number of an output shaft, leading to an impractical appliance. Thus, the portable screw-driver must be sized and designed for balancing a necessary operational capacity and a sufficient electric power to provide a corresponding output (or a battery size).

In general, the operational capacity must be so large that the appliance becomes inevitably too big to be carried by one hand. Thus, there has been need for a very compact and light electrically driven screw-driver, which is enough resistant to a severe operational condition.

In view of the foregoing, the inventor has studied for eliminating the disadvantages of the conventional charging type of portable screw-driver in the prior art and for developing a very compact, light but convenient electrically driven screw-driver, and has now found out after strict analysis of an operational procedure of the electrically driven screw-driver (hereinafter referred to merely a "screw-driver" for simplification) that a screw may be fastened into an object, which has already been threaded for receiving the screw, almost without load for about 90% of the fastening procedure and that only a finishing step of about 10% requires an instantaneously strong fastening force. On the contrary, a so-called tapping screw, which is screwed into an object without a threaded hole, may be gradually moved into the object against a considerable resistance while simultaneously making a thread. In this case, most of the working amount is directed to the tapping step and a relatively small working amount is directed to a finishing step requiring a strong fastening force.

Since the single fastening procedure has two steps as described hereinabove, it has been found out that about 90% of the total working amount required in the prefastening or screwing step is advantageously performed mechanically, while the remaining 10% in the finishing step of the strong fastening may well be performed manually without a machanical force. Actually, an extent of output to be required in the tapping work as described hereinabove may be sufficiently supplied from a charging battery of a relatively small capacity by combination of a small motor and a suitable reduction system. However, the finishing step requires much more fastening force, resulting in a big appliance with a higher power source if the fastening force is supplied electrically and mechanically. The conventional portable screw-driver has always utilized a mechanical and electrical force for performing the whole procedure or two steps of operation as described hereinbefore, thus never producing a very compact and light screw-driver which is portable in a pocket.

It will be appreciated from the foregoing that if only the prefastening or screwing step occupying most of the total work is performed mechanically but the finishing step requiring a strong fastening force (which is consumed in a very short time) is carried out manually, the mechanical size and the battery capacity may be correspondingly reduced, thereby producing a truly compact and light portable screw-driver. It has been found out, however, that there are a number of problems to be solved in order to embody the idea as described hereinabove. Firstly, when only the screwing step is carried out mechanically with a motor but the finishing step of fastening is continued by a turning movement with a hand gripping the screw-driver, the hand is suffered from a strong reverse resistance for preventing the advancing movement of the screw, so that the reduction gear (and the motor) directly connected to the driver bit starts its reverse rotation, thus never achieving the fastening operation. It has also been found out, therefore, that any means for avoiding the reverse rotation is necessary to be inserted between the driver bit and the output shaft of the reduction system. In order to avoid only the reverse movement of the driver bit, according to a principle of rheostatic braking a positive pole of a DC motor as a power source may be short-circuited to a negative pole instantaneously upon discontinuation of the rotation.

Secondly, there is a problem how to terminate the prefastening or screwing step on an optimum timing. If the termination of the screwing step is carried out by a manual ON-OFF switching operation based on an operator's intuition, any skillful operator can not always terminate the rotation on a constant timing. Further, the requirement of such the operator's intuition fails to produce an automatic appliance. The maximum output obtained on the driver bit may be adjusted to a degree of an opposite resistance generated at the end of the prefastening or screwing step for mechanically discontinuating the rotation of the driver bit. However, this operation generates an excessive mechanical load on the whole appliance upon each repeated operation and thus may not be employed in the screw-driver for use in a severe operational condition. Therefore, it is absolutely necessary for the driver bit to be automatically discontinued on the spot for its rotation upon reaching the predetermined fastening torque (or the predetermined opposite resistance), in order to terminate the screwing step on the optimum timing. Since the opposite resistance may be varied depending on materials to be fastened such as steel, wood or plastics, it will be appreciated that the fastening torque is difficult to be controlled on the optimum value for automatic discontinuation.

In view of the foregoing, it has now been found out that the first problem may be solved by providing a ratchet mechanism (capable of transmitting a rotation in only the unidirection but preventing the same in the other direction) at a portion of a chuck having a removable driver bit. Further, it has been confirmed that the ratchet mechanism is conveniently provided with a switching means for preventing the transmission of rotation power in the opposite direction upon either of the forward or reverse rotation of the screw-driver.

It has also been found out that the second problem may be solved by providing a torque controlling system having a clutch mechanism at a so-called planetary reduction system which comprises planetary gears operatively connected to a pinion gear, which in turn is connected to an output shaft of an electric motor, and an internal gear meshing with the planetary gears.

SUMMARY OF THE INVENTION

Accordingly, a general purpose of the invention is to provide an electrically driven screw-driver which is useful in a general fastening operation and is very compact and light, as well as portable in a pocket.

In order to achieve the foregoing object, in accordance with the invention, only the prefastening or screwing step occupying most of the total fastening procedure is carried out mechanically and electrically, while the finishing step requiring strong fastening force is performed manually.

PREFERRED EMBODIMENTS OF THE INVENTION

Thus, the electrically driven screw-driver according to the invention is characterized in that a ratchet device is mounted to a portion of a chucking shaft provided with a removable driver bit, said chucking shaft being connected to an output shaft of an electric motor through a planetary reduction system and that a torque controlling mechanism having a clutch function is mounted to the planetary reduction system.

In the screw-driver according to the invention, the ratchet device may comprise a ratchet gear provided at a shaft portion of a chuck, a pair of pawls oppositely arranged for holding the ratchet gear therebetween, and an operating ring for engaging and disengaging either one of said pawls with the ratchet gear through its circumferential rotation and selective pressing of the pair of pawls.

Further, in the screw-driver according to the invention, the planetary reduction system may comprise planetary gears capable of self-rotating and revolving round through a power transmitted from a pinion gear connected to the output shaft of the electric motor, an internal gear meshing with the planetary gears and providing an orbit for their revolution, and a cylindrical casing for rotatably receiving the internal gear. In this case, preferably the cylindrical casing is at its end provided with a recess for receiving a reversible switch for the electric motor, operation of said reversible switch being associated with engaging and disengaging operations of the pawls with the ratchet gear through the operational ring of the ratchet device. More preferably, the cylindrical casing is provided with a hole for receiving a steel ball while the internal gear at its circumference is provided with a notch located oppositely to the hole of the cylindrical casing and further a pressing means is provided for seating the steel ball in the hole onto the notch with a predetermined pressure. In this preferred embodiment, the pressing means may comprise a plate spring engaging at its end with the cylindrical casing, and a sliding element which slides on the plate spring to adjust steplessly the pressure of the plate spring on the steel ball.

Alternatively, a cylindrical element having a flange is fitted into the cylindrical casing, said flange of the cylindrical element being provided with a hole for receiving the steel ball and further the internal gear at its one side is provided with a flange oppositely to the hole of the cylindrical element, said flange of the internal gear being provided with a radially extending protrusion. In this case, a pressing means is arranged for urging the steel ball in the hole of the sylindrical element against the flange of the internal gear with a predetermined pressure. In this alternative preferred embodiment, the pressing means may comprise a pressing ring fitted into the cylindrical element, a coil spring inserted between the pressing ring and the electric motor, and a pressing element for axially urging the electric motor against the force of the coil spring. Preferably, the pinion gear connected to the output shaft of the electric motor is supported elastically in the axial direction.

The invention will be illustrated in more detail by the preferred embodiments but not limited thereto, with reference to the accompanying drawings.

DETAILED DESCRIPTION OF THE INVENTION

Figure 1:
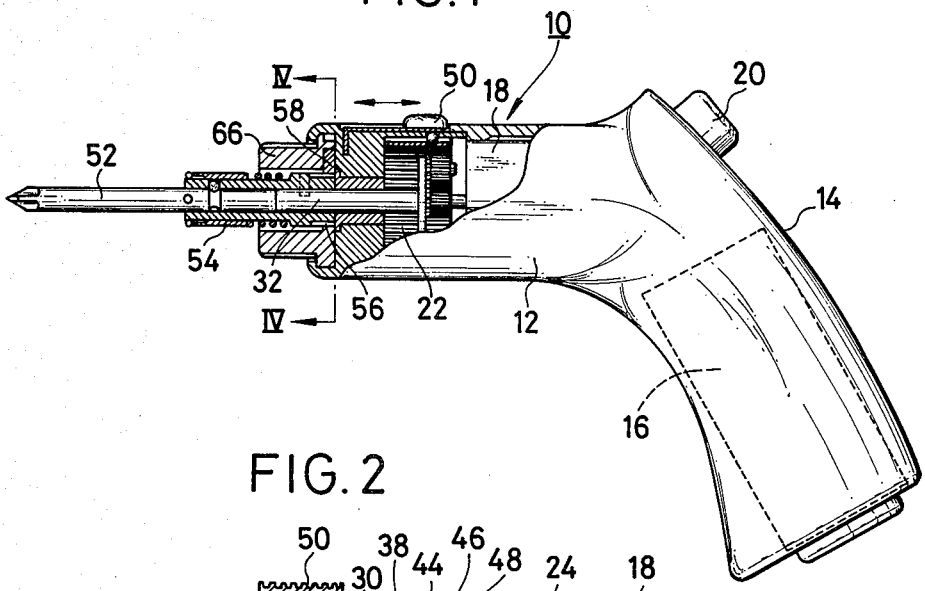
FIG. 1 is a partially sectioned front elevation of the electrically driven screw driver according to the invention.

In FIG. 1, a numeral reference 10 represents an electrically driven screw-driver (hereinafter referred to merely a "screw-driver" for simplification), an outer casing 12 of which is shaped in the pistol form as a whole. In the gripping part 14 is removably and replaceably accommodated a charging battery 16 which may be put thereinto from the bottom. The charging battery 16 is connected electrically through a reversible switch 20 to a motor 18 accommodated in a body portion of the outer casing. Further, a connection of the charging battery 16 to a plug of a charging appliance (not shown) introduced into a commercial electric source allows repeated chargings.

In the body portion of the outer casing 12 is also received a planetary reduction system 22 arranged in alignment with the motor 18. As shown in detail in FIG. 2, the planetary reduction system 22 comprises essentially an internal gear 24 of a ring element which is provided on its inner surface with a gear and planetary gears 26 coacting with the inner surface of the internal gear 24 for self-rotating while revolving round. Three planetary gears 26 may be provided, each of which is mounted to a shaft 30 arranged at an apex of regular triangle which is imaginatively drawn on a disc 28. The disc 28 at its center is provided fixedly with an axially extending output shaft 32. Each of the three planetary gears 26 coacts with a pinion gear 36 which is in turn fixed to a rotating shaft 34 of the motor 18. The output shaft 32 is rotatably inserted into and supported by a plain bearing 40 which is fixed near a bottom center of a cylindrical casing 38 encircling the planetary reduction system 22. Thus, as far as the internal gear 24 is fixed to the cylindrical casing 38, the rotation power is transmitted through the pinion gear 36, the planetary gears 26 and the disc 28 to the output shaft 32. In this case, the system may work well as a reduction device.

Figure 2:
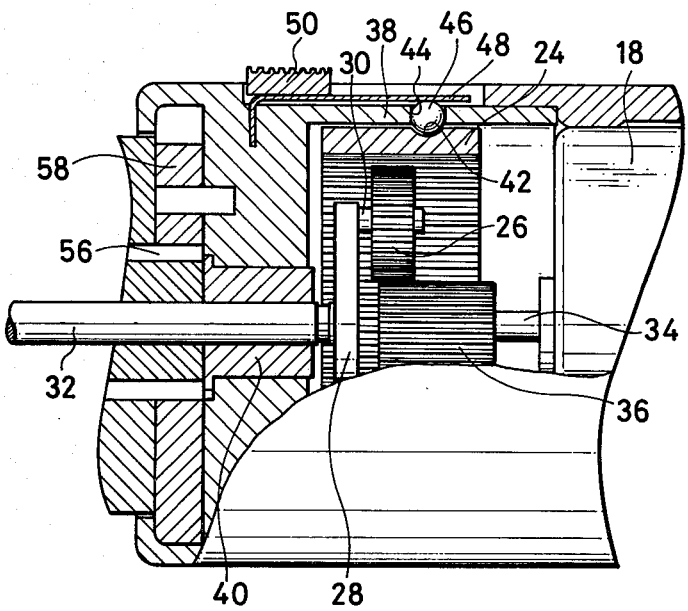
FIG. 2 is an enlarged sectional view of the planetary reduction system used in the electrically driven screw-driver of the invention.
Figure 3:
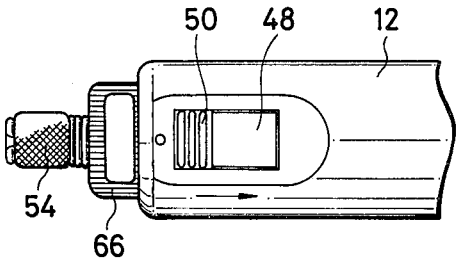
FIG. 3 is a partial side view of the outer casing of the screw-driver according to FIG. 1.

In the planetary reduction system 22 incorporated in the screw-driver according to the invention, the internal gear 24 is somewhat smaller in its outer diameter than an inner diameter of the casing 38 and is rotatably received therein. Further, the internal gear 24 is provided at its outer circumference with at least one notch 42 while the cylindrical casing 38 is provided at its corresponding position to the notch 42 with a hole 44 in order to fix the internal gear 24 to the cylindrical casing 38. Into the hole 44 is, for this purpose, removably received a steel ball 46 of a predetermined diameter, as shown in FIG. 2, which ball is elastically supported by a plate spring 48 arranged in parallel to the cylindrical casing 38 for preventing the removal of the steel ball 46 from the hole 44. In order to adjust a pressure of the plate spring 48 on the steel ball 46 as shown in FIGS. 2 and 3, a slider 50 is arranged in slidable contact with the upper surface of the plate spring 48. In this case, of course, the slider 50 may be smoothly guided in the axial direction by a sliding groove (not shown) for preventing the same from slipping out of the outer casing 12. It will be appreciated from FIG. 2 that when the slider 50 is moved axially toward the right the plate spring 48 urges the steel ball 46 more strongly into the notch 42, whereas the movement of the slider 50 toward the left may release the pressure gradually and steplessly. Thus, when the force applied circumferentially to the internal gear 24 (the force is, as described hereinafter, generated by an opposite torque transmitted from the driver bit) exceeds the pressure of the steel ball 46 applied by the plate spring 48, the steel ball 46 is lifted from the notch 42 and releases the fixation of the internal gear 24 to the cylindrical casing 38, thereby causing the idling of the internal gear 24 within the cylindrical casing 38. This means the discontinuation of power transmission, as described hereinafter.

Figure 4:
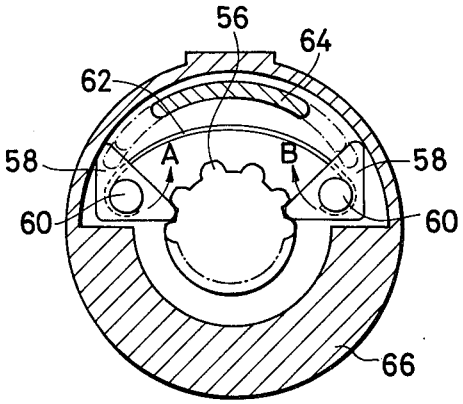
FIG. 4 is a cross sectional view taken along the line IV—IV of FIG. 1.

A ratchet device connected to the output shaft 32 of the reducer will now be described in detail with reference to FIG. 1 and FIG. 4. In FIG. 1, the output shaft 32 is provided with a well-known quick-chuck 54 for convenient mounting and removal of the driver bit 52. A sleeve portion, where the quick-chuck 54 is put onto the output shaft 32, is provided at its end with a ratchet gear 56, as shown in FIG. 4. Further, the ratchet gear 56 supports a pair of pawls 58 of triangular plate pieces, each of which swings on a shaft 60 in the axially outward direction. The ratchet gear 56 is held between the pair of pawls 58, 58, their sharp edges of which mesh with the former. The oppositely arranged pair of pawls 58, 58 are engaged with a wire spring 62, which imparts an elastically restoring force to each of the pawls in the directions A and B, as shown by arrows in FIG. 4. Further, a pawl-pressing lever 64 of an arc shape is arranged circumferentially and slidably over a predetermined angle, while the outer casing 12 is provided with a turnable cylindrical cap 66 of a pot type into which the lever 64 is received. The pressing lever 64 is determined in such a size that the top end thereof may contact either one of the pawls 58 in the extreme limit of its turning angle and urge the contacted pawl 58 swingably toward the opposite direction relative to the arrows A and B against the elastic force applied by the wire spring 62, as shown in FIG. 4. A suitable click stop mechanism may be provided for ensuring reliable stoppage of the cap 66 at each position for forward, fixed or reverse rotation.

In accordance with the ratchet mechanism as described hereinbefore, the anticlockwise sliding movement of the lever 64 urges the pawl 58 (the left side in FIG. 4) swingably in the anticlockwise direction, thereby disengaging the sharp edge of the pawl 58 from the ratchet gear 56. If the ratchet gear 56 is turned clockwise, then the other pawl 58 (the right side in FIG. 4) swings anticlockwise against the elastic force applied by the wire spring 62 and is disengaged from one tooth of the ratchet gear 56, thereby allowing one tooth of the ratchet gear to move clockwise and unidirectionally. Then, the pawl 58 is engaged with the next tooth under the elastic action of the wire spring 62. Such repeated procedures allow the further clockwise and unidirectional movement of the ratchet gear 56 (and hence the driver bit 52). On the contrary, even if a turning force is applied to the ratchet gear 56 for anticlockwise movement, the pawl 58 (the right side in FIG. 4) is prevented from swinging by contact thereof with a shoulder of the other element, thereby ensuring the engagement of the pawl 58 with the ratchet gear 56 and preventing the anticlockwise movement of the latter. If the pressing lever 64 is slided clockwise, then the ratchet gear 56 operates conversely, thereby allowing the anticlockwise and unidirectional movement but preventing the clockwise movement. Further, when the lever 64 is held at the neutral position, the ratchet gear 56 is prevented from the turning in either direction and fixed.

Now the operation of the screw-driver according to the invention will be described hereinbelow.

At first, the ratchet mechanism is set to a forward turning position and the slider 50 is adjusted to give a suitable pressure on the steel ball, thus starting a fastening operation. When the fastening operation proceeds and approaches to the end of the prefastening or screwing step, resistance to the fastening increases gradually to reach the predetermined value of the torque. At this point, the load due to the resistance from the driver bit 52 is transmitted successively through the output shaft 32, the disc 28, the planetary gears 26, the internal gear 24 and the steel ball 46 to the cylindrical casing 38. If the load exceeds the radial pressure on the steel ball 46 applied by the plate spring 48, the ball 46 is forcibly removed from the notch 42, thereby releasing the fixation of the internal gear 24 relative to the cylindrical casing 38. Thus, the power transmission from the pinion gear 36 is interrupted to discontinue the rotation of the output shaft 32 on the spot. Consequently, the output shaft of the screw-driver discontinues its rotation automatically at the optimum fastening torque which has been preset, thereby eliminating any operator's skill and intuition.

After the procedure described hereinabove, the finishing step of fastening is completed by turning the gripping part 14 manually, because the driver bit 52 is operatively associated with the ratchet mechanism in the forward direction. Generally, the turning angle of the gripping part 14 is in the order of 30°, but the ratchet mechanism allows the fastening step of any angle to be completed by the repeated movement of the gripping part while keeping the driver bit 52 fitted into a slot of screw. On the contrary, strongly fastened screw may be unfastened manually at first by changing the turning direction of the ratchet mechanism and then withdrawn mechanically by the electric motor.

Figure 5:
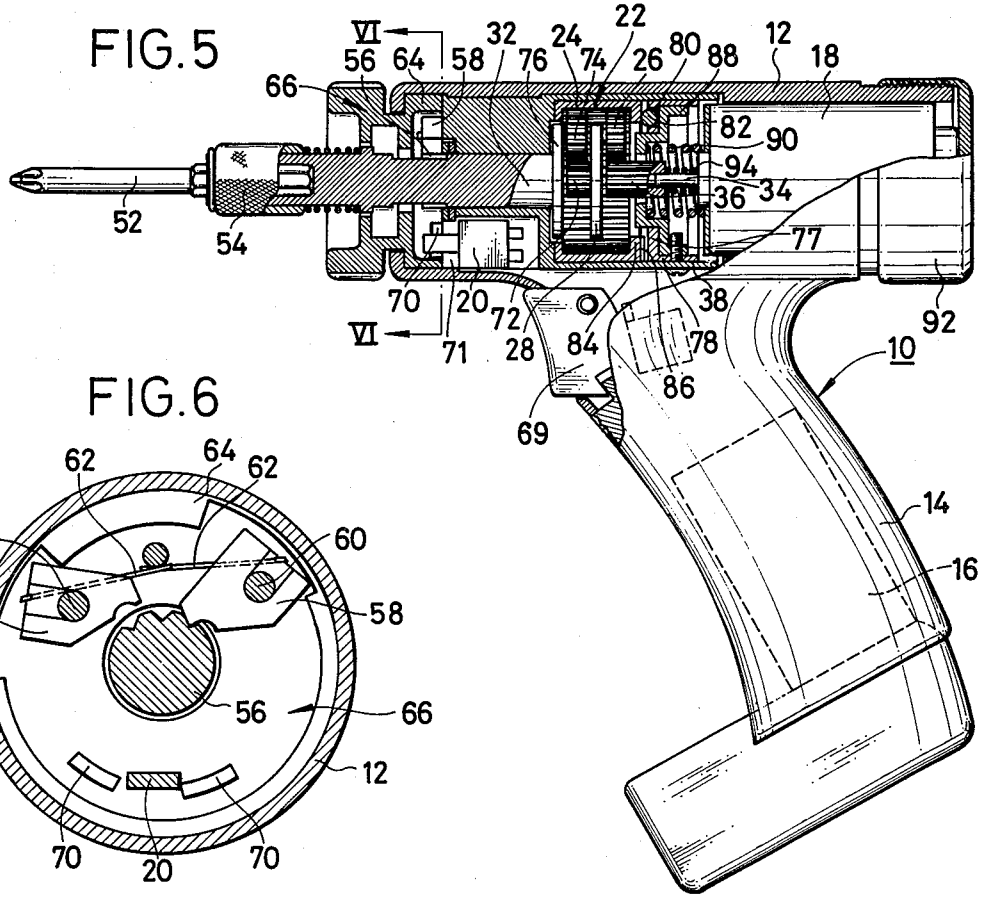
FIG. 5 is a partially sectioned front elevation of the screw-driver of another embodiment according to the invention.
Figure 6:
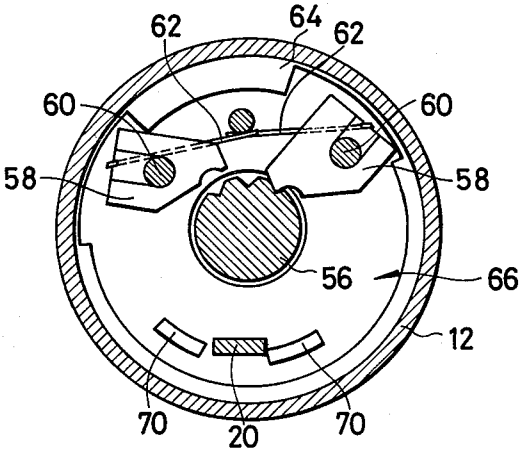
FIG. 6 is a cross sectional view taken along the line V—V of FIG. 5.

FIGS. 5 and 6 show another embodiment of the screw-driver according to the invention.

In accordance with this embodiment, an operating element 69 for a power switch 68 is arranged above the gripping part 14 of the outer casing 12, while a reversible switch 20 for the motor 18 connected in series to the power switch 68 is received in a recess 71 formed in the cylindrical casing at its end. The reversible switch 20 is arranged between a pair of operational pieces 70, 70 provided within the cylindrical cap 66, as shown in FIG. 5, so that the engaging and disengaging operations of the pawls 58 with the ratchet gear 56 may be associated with the switching operation of the reversible switch 20.

As the planetary reduction system 22, a double reduction system is employed which comprises a power transmitting gear 72 arranged at the shaft of the disc 28, a second planetary gear 74 meshing with the gear 72, and a disc 76 fixed to the output shaft 32 and supporting the second planetary gear 74. Within the cylindrical casing 38 is fitted a cylindrical element 78 having a flange 77 adjacent to the internal gear 24. The flange 77 is provided with a hole 80 into which is received a steel ball 82, while the internal gear 24 at its one side is provided with a flange 84 on which is extented an axial protrusion 86. Into the cylindrical element 78 is fitted a pressing ring 88. Between the ring 88 and the motor 18 is arranged a coil spring 90. Onto the outer casing 12 is screwed a cap 92, rotation of which permits the steel ball 82 in the hole 80 to be urged against the flange 84 of the internal gear 24 through the motor 18, the coil spring 90 and the ring 88. Over the shaft 34 of the motor 18 is arranged a coil spring 94 for supporting the pinion gear 36 eleastically to the axial direction.

Upon operation of the screw-driver according to the embodiment described hereinbefore, the cylindrical cap 77 is turned to preset the ratchet mechanism and the reversible switch 20 at the forward turning position, while the cap 92 is adjusted to have a desired pressure on the steel ball 82.

Then, the power switch 68 is turned on for starting the fastening operation. When the operation proceeds and approaches to the end of the prefastening or screwing step, the resistance increases gradually to reach the predetermined value of torque. Then, the load due to the resistance is transmitted from the driver bit 52 through the output shaft 32 and the disc 76 to the second planetary gear 74 (in this case, the load is enough heavy to be transmitted to the second planetary gear 74 rather than to the transmission gear 72) and further from the second planetary gear 74 through the internal gear and the protrusion 86 to the steel ball 82. When the load exceeds the pressure on the steel ball applied in the thrust direction by the pressing ring, the steel ball 82 is pushed over the protrusion 86 of the flange 84 provided on the internal gear 24, thereby releasing the fixation of the internal gear 24 to the cylindrical casing 38. Thus, the power transmission from the pinion gear 36 is interrupted on the spot to discontinue the rotation of the output shaft 32. Consequently, the discontinuation of rotation of the output shaft at the optimum fastening torque permits any operator's skill and intuition to be eliminated and the finishing step of fastening to be performed conveniently.

In addition, since the switching operation of the ratchet mechanism by means of the cylindrical cap is associated with the switching operation of the reversible switch for the motor, the handling and operation of the screw-driver according to the invention is very convenient. Furthermore, utilization of the double reduction system as a planetary reduction mechanism permits the desired output to be readily obtained.

In accordance with the electrically driven screw-driver of the invention, the capacity and number of the charging batteries may be small, resulting in a very compact and light appliance, which is very convenient in portability.

The foregoing is to be considered as descriptive and not limitative as many changes and modifications may be made therein without departing from the concept of the invention.

What is claimed is:

1. An electrically driven screw-driver comprising a ratchet device mounted to a portion of a chucking shaft to which a driver bit is detachably connected, said chucking shaft being connected to the output shaft of an electric motor through a planetary reduction system, said planetary reduction system comprising a plurality of planetary gears each capable to self-rotating and revolving around a pinion gear of a power transmission connected to the output shaft of the electric motor, and having an internal gear ring coacting with the planetary gears providing an orbit for their revolution, a cylindrical casing for rotatably receiving the internal gear and a torque controlling mechanism having a clutch function mounted between said casing and the planetary reduction system, said torque controlling mechanism comprising a steel ball contacting an outer circumferencial surface of the internal gear and means for pressing the steel ball against the internal gear with a predetermined pressure.

2. The electrically driven screw-driver according to claim 1, characterized in that the ratchet device comprises a ratchet gear provided at a shaft portion of a chuck, a pair of pawls oppositely arranged for holding the ratchet gear therebetween, and an operating ring engaging and disengaging either one of said pawls with the ratchet gear through its circumferential rotation and selective pressing of said pair of pawls.

3. The electrically driven screw-driver according to claim 1, characterized in that the cylindrical casing at its end is provided with a recess for receiving a reversible switch for the electric motor, operation of said reversible switch being associated with engaging and disengaging operations of the pawls with the ratchet gear by the operational ring of the ratchet device.

4. The electrically driven screw-driver according to claim 1, characterized in that the cylindrical casing is provided with a hole for receiving a steel ball while the internal gear at its circumference is provided with a notch located oppositely to the hole of said cylindrical casing, and that a pressing means is provided for seating the steel ball in the hole onto the notch with a predetermined pressure.

5. The electrically driven screw-driver according to claim 4, characterized in that the pressing means comprises a plate spring engaging at its end with the cylindrical casing, and a sliding element which slides on the plate spring to adjust steplessly the the pressure of the plate spring on the steel ball.

6. The electrically driven screw-driver according to claim 3, characterized in that a cylindrical element having a flange is fitted into the cylindrical casing, said flange of the cylindrical element being provided with a hole for receiving the steel ball that the internal gear at its one side is provided with a flange oppositely to the hole of the cylindrical element, said flange of the internal gear being provided with a radially extending protrusion, and that a pressing means is provided for urging the steel ball in the hole of said cylindrical element against the flange of the internal gear with a predetermined pressure.

7. The electrically driven screw-driver according to claim 6, characterized in that the pressing means comprises a pressing ring fitted into the cylindrical element, a coil spring inserted between the pressing ring and the electric motor, and a pressing element for axially urging the electric motor against the force of the coil spring.

8. The electrically driven screw-driver according to claim 7, characterized in that the pinion gear connected to the output shaft of the electric motor is supported elastically in the axial direction.

* * * * *